United States Patent [19]

Hildebrand

[11] 4,027,897

[45] June 7, 1977

[54] SAFETY SKI BINDING

[76] Inventor: Kurt Hildebrand, Steingaden 43, Sulzberg, Germany, 8961

[22] Filed: Nov. 25, 1975

[21] Appl. No.: 635,170

[52] U.S. Cl. ..... 280/631

[51] Int. Cl.[2] ..... A63C 9/08

[58] Field of Search ..... 280/631, 632

[56] References Cited

UNITED STATES PATENTS

| | | | |
|---|---|---|---|
| 3,317,217 | 5/1967 | Poiger | 280/632 |
| 3,689,097 | 9/1972 | Smolka | 280/631 |
| 3,734,520 | 5/1973 | Hashioka | 280/632 |
| 3,754,770 | 8/1973 | Suhner | 280/632 |

FOREIGN PATENTS OR APPLICATIONS

| | | | |
|---|---|---|---|
| 2,432,646 | 8/1974 | Germany | 280/631 |

*Primary Examiner*—Robert R. Song
*Attorney, Agent, or Firm*—M. Ted Raptes

[57] ABSTRACT

The invention concerns a safety ski binding for the toe and/or heel with a spring loaded holding jaw that pivots around an axle with the other end of the spring attached to the housing which is mounted on the ski.

10 Claims, 3 Drawing Figures

SAFETY SKI BINDING

Figure 1:
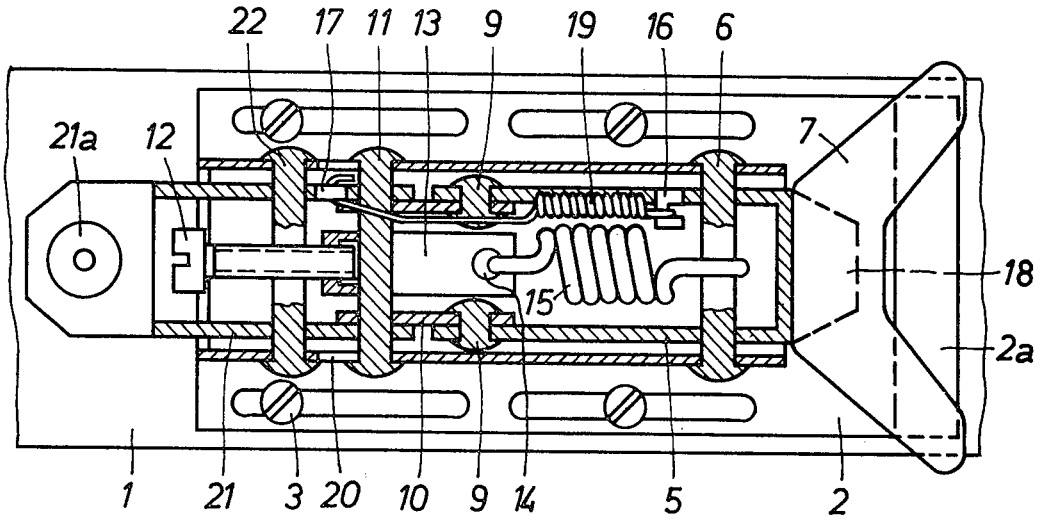

Known bindings of this type do not have the desired shock travel, that is, they release after a slight movement of the holding jaw. The invention provides a safety ski binding with a long shock travel by relatively simple means. This is achieved by attaching the other end of the spring to an adjusting device which at its forward end is connected to the holding jaw by means of an arm link and at it other end to the housing by means of the release lever. This special arrangement of arms and levers enables the spring tension to be applied to the holding jaw in such a way that short shock movements do not cause premature release and the shoe is released only when the pre-set tension has been exceeded. An important advantage of this system is that is has very little internal friction.

Further details of the invention are described in the drawing explanations.

FIG. 1. A top view of the safety ski binding invention for the heel, partly in section.

Figure 2:
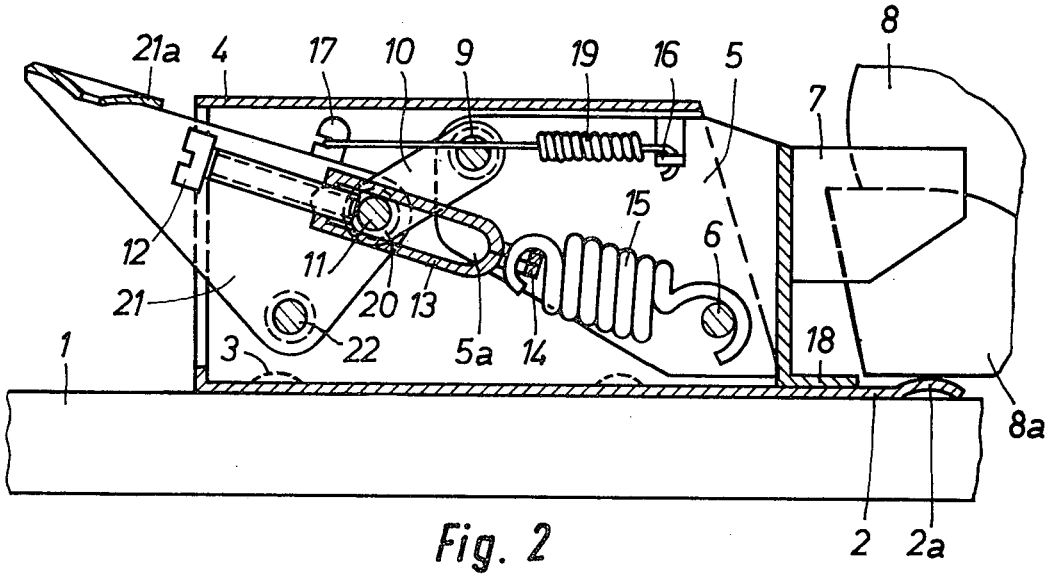

FIG. 2. A side view of the ski binding in FIG. 1, partly in section.

Figure 3:
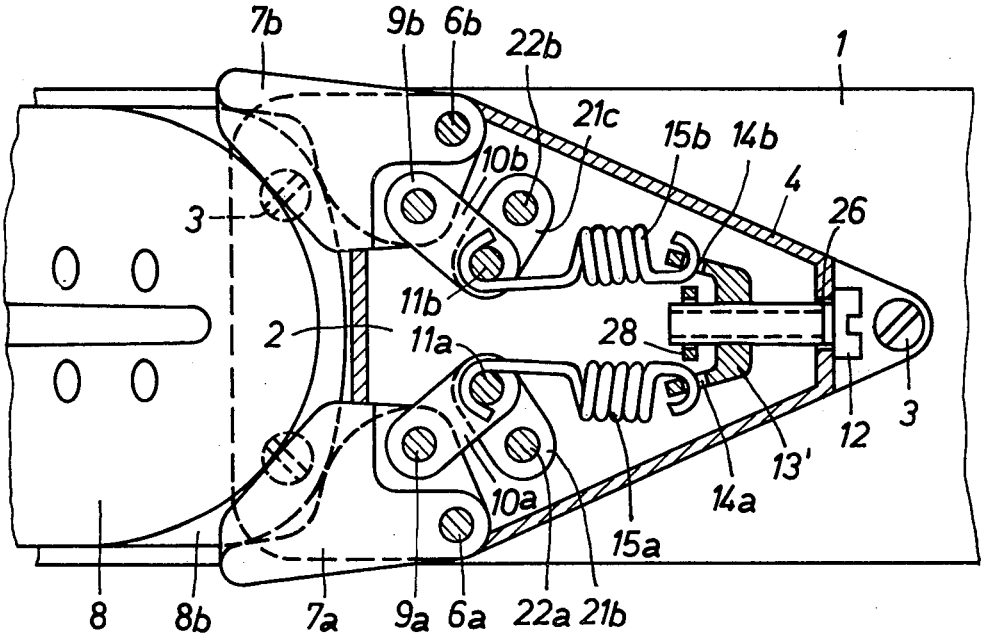

FIG. 3. A top view of the safety ski binding invention for the boot toe, partly in section.

The safety ski binding for the heel shown in FIG. 1 + 2 has a base plate 2 mounted on the ski 1 by means of screws 3. The front end of the base has a raised heel rest 2*a*. Housing 4 is attached to base plate 2, preferably with an elastic adjustment lengthwise. Holding jaw 7 is attached to holding jaw lever 5, preferably adjustable as to height and serves to grip heel 8*a* of boot 8. The lower forward end of holding jaw lever 5 is pivotably attached to housing 4 by means of axle 6 and at the opposing upper end to arm link 10 by means of pivot bolt 9. The other end of arm link 10 is pivotably connected to the upper part of release lever 21 by means of release bolt 11. The lower part of release lever 21 is pivotably attached to housing 4 by means of an axle 22. The opposite end of release lever 21 contains a concave actuating portion 21*a*. Adjusting device 13 is mounted on release bolt 11 and its position relative to bolt 11 can be varied by means of tension adjusting screw 12. The forward end of adjusting device 13 contains a hole 14 to which tension spring 15 is attached, the other end of which is connected to axle 6. Slot 20 on both sides of housing 4 serves as a forward stop for release bolt 11. Auxiliary tension opening spring 19 is attached to hook 16 on the top left edge of holding jaw lever 5 on one end and to hook 17 on the top left edge of release lever 21 at its other end. The lower left corner 5*a* of holding jaw lever 5 serves as an angle stop. To place the boot 8 into the safety ski binding of the invention, the release lever actuator 21*a* is depressed by hand or with the ski pole tip, causing the holding jaw 7 to move upward and open the binding. The ski boot 8 is then placed into the binding and the heel 8*a* pressed downward, contacting heel spur 18 and causing holding jaw 7 to grip heel 8*a* by means of tension spring 15. The movement of holding jaw 7 is limited in the closed position by release bolt 11 resting against slot 20 in housing 4. When a force moves holding jaw 7 upward, holding jaw lever 5 rotates counterclockwise around axle 6 causing pivot bolt 9 to move down and back whereby arm link 10 moves release bolt 11 backward together with adjusting device 13. Spring 15 is thereby placed under tension. The geometrical arrangement shown in FIG. 2 whereby bolt 11 is moved back relative to bolt 9 and the resulting angle of arm lever 10 to holding jaw lever 5 produces the long shock travel of the binding. That is, a small movement of holding jaw 7 produces initially a large movement of adjustment device 13 and increased tension of spring 15 which tends to return the boot 8 to its original position resisting release of the safety ski binding. When the holding force set by adjusting screw 12 has been reached, a slight increase will release the binding and free the boot. At the moment when pivot bolt 9 reaches the line formed between release bolt 11 and axle 6, the holding force drops to zero. At this point, auxilliary tension spring 19 pulls holding jaw lever 5 back, causing bolt 9 to drop under this line. Thereupon tension spring 15 again takes effect and the binding rests in the open position. The opening angle assumed by holding jaw 7 is limited by stop 5*a* resting against base plate 2.

The safety ski binding for the boot toe shown in FIG. 3 is an application of the invention with side release. The sole 8*b* of the boot 8 is gripped by two holding jaws 7*a* and 7*b*, each of which pivots independently around axles 6*a* and 6*b* which are fastened to base plate 2. Arm links 10*a* and 10*b* are each pivotally attached to the respective holding jaw levers 7*a* and 7*b*, at one end by means of pivot bolts 9*a* and 9*b*, and the other end to the respective arm links 21*b* and 21*c* by means of release bolts 11*a* and 11*b*. The other end of arm links 21*b* and 21*c* pivots in turn around axles 22*a* and 22*b* which are fastened to base plate 2. Tension springs 15*a* and 15*b* are attached respectively to the release bolts 11*a* and 11*b* at one end and in turn to holes 14*a* and 14*b* in a modified adjusting device 13′ at the other end. Adjusting screw 12 is supported at one end by a hole 26 in housing 4 and at the other end by a hole in support 28 on base plate 2. Adjusting device 13′ has internal threads, and by turning adjusting screw 12 changes its position relatively to same. The binding has the same basic function system as the one shown in FIG. 1 and FIG. 2.

I claim:

1. A safety ski binding comprising spring-loaded, releasable holding jaw means for the heel of a ski boot comprising:

a. housing means detachably connected to the surface of a ski comprising parallel vertical side members, and forward and rear axle means disposed transversely between said side members at a lower portion thereof;

b. jaw lever means within said housing means disposed pivotally on said forward axle means and comprising holding jaw means connected to said jaw lever means extending forwardly of said housing means;

c. release bolt means disposed transversely between said side members above said axle means and adapted to be movable and adjustable in parallel slot means contained in said side members, said jaw lever means connected pivotally to said release bolt means by link means;

d. release lever means within said housing means disposed pivotally on said rear axle means and on said release bolt means comprising, actuating means connected to said release lever means and extending rearwardly of said housing means;

e. tension adjusting and release means disposed within said housing means comprising, adjusting member means disposed pivotally on said release bolt means, tension spring means connected between said adjusting member and said forward axle means; and auxiliary tension spring means connected between said jaw lever means and said release lever means.

2. The safety ski binding of claim 1, wherein adjusting screw means are disposed in the end of said adjusting member means adapted to contact said release bolt means, whereby the holding tension of said holding jaw means on the heel of said ski boot can be adjusted.

3. The safety ski binding of claim 1, wherein the rear portion of said jaw lever means and one end of said link means are pivotally connected to pivot bolt means, and wherein the other end of said link means is pivotally connected to said release bolt means.

4. The safety ski binding of claim 3, wherein said pivot bolt means is disposed forwardly of said release bolt means.

5. The safety ski binding of claim 1, wherein said holding jaw means and said jaw lever means pivot around said forward axle means.

6. The safety ski binding of claim 1, wherein said parallel slot means are disposed forwardly and downwardly in said side members.

7. The safety ski binding of claim 1, wherein said jaw lever means comprises opening stop means.

8. The safety ski binding of claim 1, wherein said auxiliary spring means is connected across the upper portion of said jaw lever means and said release lever means.

9. The safety ski binding of claim 1, wherein said housing means comprises heel spur means disposed below said holding jaw means.

10. The safety ski binding of claim 1, wherein said housing means comprises base plate means having elongated slot means whereby said housing can be adjustably connected to said ski surface, said base plate means comprising heel rest means disposed below said holding jaw means.

* * * * *